US008215325B2

(12) United States Patent
Montanti

(10) Patent No.: US 8,215,325 B2
(45) Date of Patent: Jul. 10, 2012

(54) CALF, ANKLE, FOOT, OR LEG REST FOR CANE AND CANE WITH DEVICE ATTACHED

(76) Inventor: John A. Montanti, Monroe Township, NJ (US)

( * ) Notice: Subject to any disclaimer, the term of this patent is extended or adjusted under 35 U.S.C. 154(b) by 0 days.

(21) Appl. No.: 10/597,024

(22) PCT Filed: Jun. 22, 2006

(86) PCT No.: PCT/US2006/024035

§ 371 (c)(1),
(2), (4) Date: Jul. 7, 2006

(87) PCT Pub. No.: WO2007/061450

PCT Pub. Date: May 31, 2007

(65) Prior Publication Data

US 2009/0151761 A1 Jun. 18, 2009

Related U.S. Application Data

(60) Provisional application No. 60/743,077, filed on Dec. 25, 2005, provisional application No. 60/597,177, filed on Nov. 15, 2005.

(51) Int. Cl.
*A45B 3/00* (2006.01)
*A61H 3/00* (2006.01)

(52) U.S. Cl. ..... 135/66; 135/65; 135/71; 135/74; 280/819; 248/155.5; 482/76

(58) Field of Classification Search ..... 135/65–66, 135/68, 71–74, 76, 77; 42/94; 280/812, 280/819, 821; 248/155, 155.2, 155.5, 671, 248/308, 205.1, 15, 155.6; 602/23–26; D3/5–10; 297/118, 129, 423
See application file for complete search history.

(56) References Cited

U.S. PATENT DOCUMENTS

| | | | | | |
|---|---|---|---|---|---|
| 266,630 | A | * | 10/1882 | Jambers | 297/423.39 |
| 1,120,305 | A | * | 12/1914 | Graves | 135/68 |
| 2,057,013 | A | * | 10/1936 | Curtis | 482/76 |
| 2,378,486 | A | * | 6/1945 | Jones | 135/68 |
| 2,678,054 | A | * | 5/1954 | Otto | 135/68 |

(Continued)

FOREIGN PATENT DOCUMENTS

| | | |
|---|---|---|
| DE | 342106 | 3/1920 |

(Continued)

*Primary Examiner* — Winnie Yip
(74) *Attorney, Agent, or Firm* — Stanley H. Kremen

(57) ABSTRACT

A calf, ankle, foot, or leg rest device which can be snapped onto a cane for use or snapped off when only the use of the cane is desired. The invention also encompasses the combination cane and rest device. Many people who either have a permanent leg, knee, or foot disability or are recovering from a leg, knee, or foot operation are required to keep their leg in a horizontal position while seated. The rest device is a J-shaped soft padded bracket that is rigidly attached to the cane. The height of the bracket along the cane is adjustable to provide comfort and ease of use. The cane may be positioned at a convenient horizontal distance from the user as desired. In this way, the user may rest his or her calf, ankle, or heel on the rest device. Once the rest device is engaged by the user's leg, the cane is perfectly balanced on the ground. A user can comfortably keep his leg in a horizontal position for hours.

26 Claims, 22 Drawing Sheets

U.S. PATENT DOCUMENTS

| | | | | | |
|---|---|---|---|---|---|
| 2,778,370 | A | * | 1/1957 | Chamblee | 135/68 |
| 3,576,084 | A | * | 4/1971 | Anderson, Jr. | 42/94 |
| 3,985,148 | A | * | 10/1976 | Cadman | 135/66 |
| 4,291,715 | A | * | 9/1981 | Monte | 135/68 |
| 4,402,385 | A | * | 9/1983 | Buche | 182/91 |
| 4,601,302 | A | | 7/1986 | Breen et al. | |
| 4,997,001 | A | | 3/1991 | DiCarlo | |
| 5,456,437 | A | * | 10/1995 | Chander et al. | 248/316.7 |
| 5,462,334 | A | * | 10/1995 | Sedorcek et al. | 297/252 |
| 5,524,657 | A | * | 6/1996 | Jih | 135/66 |
| 5,566,915 | A | * | 10/1996 | Hansare | 248/188.8 |
| 5,692,533 | A | | 12/1997 | Meltzer | |
| 5,794,638 | A | | 8/1998 | Richey et al. | |
| 5,806,548 | A | | 9/1998 | Goldstein et al. | |
| D419,288 | S | * | 1/2000 | Hartfield | D3/7 |
| 6,491,050 | B2 | * | 12/2002 | Whiddon | 135/66 |
| 7,493,719 | B2 | * | 2/2009 | Lackey | 42/94 |
| 2003/0098051 | A1 | * | 5/2003 | Fismer | 135/66 |

FOREIGN PATENT DOCUMENTS

| | | | |
|---|---|---|---|
| DE | 10056120 | A1 | 11/1999 |
| EP | 0841054 | A3 | 12/1999 |
| GB | 2303061 | | 12/1997 |

* cited by examiner

FIG. 18a
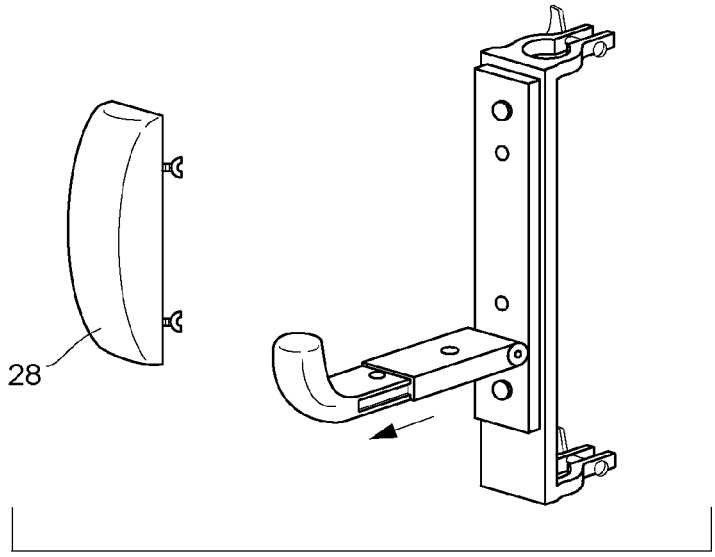
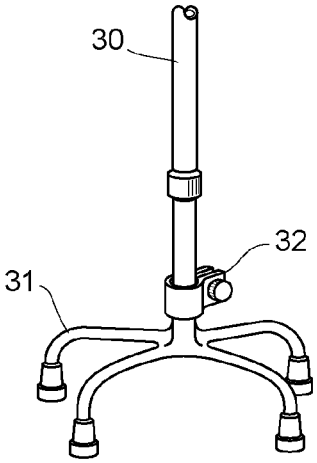
FIG. 19a
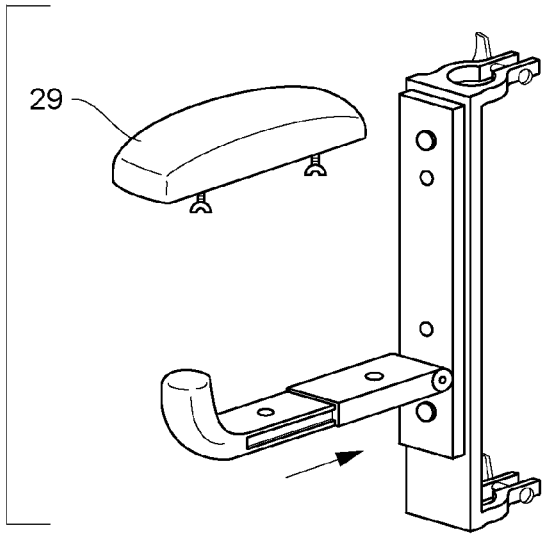
FIG. 18b

CALF, ANKLE, FOOT, OR LEG REST FOR CANE AND CANE WITH DEVICE ATTACHED

CROSS REFERENCE TO RELATED APPLICATIONS

The Present Non-Provisional Patent Application is being filed pursuant to 35 U.S.C. §371 as a U.S. National Stage Patent Application deriving from PCT International Application No. PCT/US 06/24035 filed on Jun. 22, 2006 under the Patent Cooperation Treaty which is the non-provisional counterpart to U.S. Provisional Application Ser. No. 60/597,177 filed on Nov. 17, 2005 and U.S. Provisional Application Ser. No. 60/743,077 filed on Dec. 25, 2005. The Present National Stage Application PCT Application claims the benefit of and priority to the PCT Application and to both U.S. provisional applications cited herein.

BACKGROUND OF THE INVENTION

Many people who either have a permanent leg, knee, or foot disability or are recovering from a leg, knee, or foot operation are required to keep their leg in a horizontal position while seated. These people usually rest a leg on a chair or a hassock. Using a chair for this purpose often creates great discomfort. A hassock is more comfortable than a chair, but it is not very portable. There is a need for an easy to use portable device that would allow a disabled person to comfortably position his or her leg.

SUMMARY OF THE INVENTION

The invention disclosed herein is a calf, ankle, foot, or leg rest device which can be snapped onto a cane for use or snapped off when only the use of the cane is desired. The invention also encompasses the combination cane and rest device. The rest device is a J-shaped soft padded bracket that is rigidly attached to the cane. The height of the bracket along the cane is adjustable to provide comfort and ease of use. The cane may be positioned at a convenient horizontal distance from the user as desired. In this way, the user may rest his or her calf, ankle, or heel on the rest device. Once the rest device is engaged by the user's leg, the cane is perfectly balanced on the ground. A user can comfortably keep his leg in a horizontal position for hours.

The First U.S. Provisional Application Ser. No. 60/597,177, filed on 17 Nov. 2005, disclosed a detachable resting device which is fastened to a cane. The resting device is able to accommodate a persons calf, ankle, foot, or leg, and to maintain it in a horizontal position. The Second U.S. Provisional Application Ser. No. 60/743,077, filed on 25 Dec. 2005, disclosed certain improvements to the invention disclosed in the First Provisional Application.

The first improvement is a J-shaped resting device wherein the bottom part of the "J" is hinged to the vertical stem of the "J." Ordinarily, the bottom part of the "J" protrudes horizontally. However, the improved resting device allows the bottom part to be moved into a vertical position to make using the cane more convenient when the user is walking.

The second improvement to the resting device described above is to the mechanism that mounts the resting device to the cane.

The third improvement to the resting device described above is to the soft padding that cushions the user's calf, ankle, foot, or leg.

The fourth improvement to the resting device described above is that the linear dimension of the bottom part of the "J" may be changed to accommodate a larger size calf, ankle, foot, or leg.

The fifth improvement is to the cane itself. Disclosed herein is a separate detachable quad cane base that can replace the standard single cane tip.

The sixth improvement is also to the cane itself. Disclosed herein is a cane wherein the cane grip doubles as the resting device.

The seventh improvement is the use of two identical resting devices mounted opposite to each other on the cane. This creates a cane whereby a user may elevate both legs to a horizontal position.

BRIEF DESCRIPTION OF THE DRAWINGS

FIG. 15(*b*) is a left side isometric view of the cane with the resting device is in the "flat down" position.

FIG. 15(*c*) is a left side isometric view of the resting device.

FIG. 15(*d*) is a left side view of the cane with the resting device in the "upright" (use) position.

FIG. 15(*e*) is a left side view of the cane with the resting device in the "flat down" position.

FIG. 15(*f*) is a left side view of the cane showing the resting device pivoting through various positions between the "upright" (use) position and the "flat down" position.

FIG. 16(*b*) shows the back pad of the resting device.

FIG. 16(*c*) shows the lower pad of the resting device.

FIG. 16(*d*) shows the resting device with the soft pads.

FIG. 17(*b*) shows the lower pad of the resting device.

FIG. 18(*a*) shows the resting device in the standard width position.

FIG. 18(*b*) shows the resting device in the wide width position.

FIG. 19(*a*) shows how the quad cane base attaches to the cane.

FIG. 19(*b*) shows a more detailed view of the base.

FIG. 20(*a*) shows the resting device mounted as the cane hand rest.

FIG. 20(*b*) shows the hand rest detaching from the cane.

FIG. 20(*c*) shows the cane itself without the resting device.

FIG. 20(*d*) shows the cane with the mounted foot rest.

FIG. 22(*a*) shows the resting device in the standard width position and in the "upright" position.

FIG. 22(*b*) shows the resting device in the wide width position and in the "upright" position.

FIG. 22(*c*) shows the resting device in the "flat down" position.

FIG. 22(*d*) is a cross-sectional view of the leg rest and pivot point indicated by the section marking in FIG. 22(*b*). The leg rest is in the horizontal position.

FIG. 22(*e*) is a cross-sectional view of a typical lock mechanism indicated by the section marking in FIG. 22(*b*) where the leg rest is in the horizontal locked position. FIG. 22(*e*) corresponds to the condition of the leg rest in FIG. 22(*d*).

FIG. 22(*f*) is a cross-sectional view of the leg rest and pivot point indicated by the section marking in FIG. 22(*b*). The leg rest is in the horizontal position, but unlocked to pivot downward.

FIG. 22(*g*) is a cross-sectional view of the typical lock mechanism of FIG. 22(*e*) and corresponding to the condition of the leg rest in FIG. 22(*f*), where the leg rest is in the horizontal unlocked position.

FIG. 22(*h*) is a cross-sectional view of the leg rest and pivot point corresponding to the view in FIG. 22(*c*), where the leg rest is in the vertical position.

FIG. 22(*i*) is a cross-sectional view of the typical lock mechanism of FIG. 22(*e*), and corresponding to the condition of the leg rest in FIG. 22(*h*), where the leg rest is in the vertical unlocked position.

FIG. 22(*j*) is a cross-sectional view of the leg rest and pivot point indicated by the section marking in FIG. 22(*c*). The leg rest is in the vertical position.

FIG. 22(*k*) is a cross-sectional view of the typical lock mechanism of FIG. 22(*e*), as indicated by the section marking in FIG. 22(*c*), where the leg rest is in the vertical locked position. FIG. 22(*k*) corresponds to the condition of the leg rest in FIG. 22(*j*).

FIG. 23(*a*) shows the resting device in the standard width position and in the "upright" position.

FIG. 23(*b*) shows the resting device in the wide width position and in the "upright" position.

FIG. 23(*c*) shows the resting device in the "flat down" position.

FIG. 25(*b*) shows wide width horizontal and vertical soft pads together.

FIG. 26(*a*) shows the mounting of the attachment strip on the rear surface of the vertical soft pad.

FIG. 26(*b*) shows the front surface of either the horizontal or vertical soft pad.

FIG. 26(*c*) shows the mounting of the attachment strip on the rear surface of the horizontal soft pad.

FIG. 26(*d*) shows the mating attachment strips mounted on the resting device in the "upright" position.

FIG. 26(*e*) shows the mating attachment strips mounted on the resting device in the "flat down" position.

DETAILED DESCRIPTION OF THE INVENTION

Figure 1:
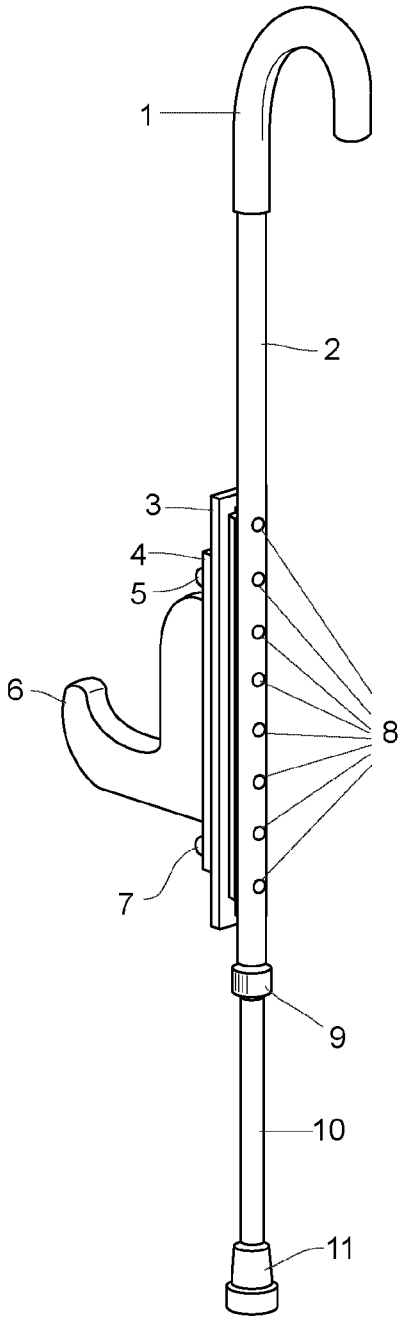
FIG. 1 is an isometric view of the cane showing the calf, ankle, foot, or leg rest positioned using mounting holes located on the opposite side of the cane. The mounting holes in the rear of the cane are visible.
Figure 2:
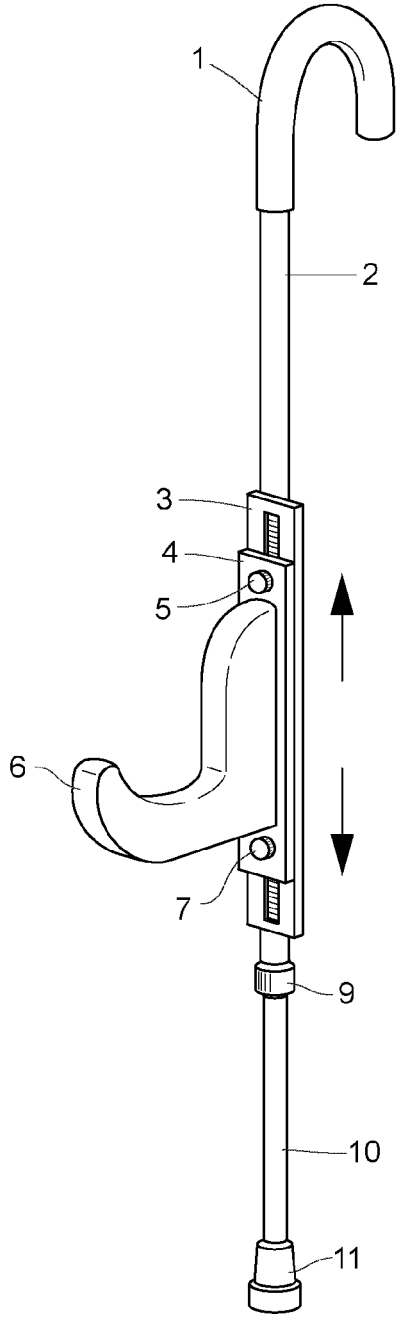
FIG. 2 is an isometric view of the cane rotated 90° counterclockwise from FIG. 1 about the longitudinal axis of the cane.

The invention disclosed herein is a calf, ankle, foot, or leg rest device (hereinafter, Resting Device) and a cane modified by having the Resting Device movably mounted thereon. FIG. 1 is an isometric view of the cane showing the Resting Device positioned using mounting holes located on the opposite side of the cane. The mounting holes in the rear of the cane are visible. FIG. 2 is an isometric view of the cane rotated 90° counter-clockwise from FIG. 1 about the longitudinal axis of the cane. Referring to FIGS. 1 and 2, the basic cane comprises a hand grip, 1; an upper cane section, 2; cane height adjustment holes, 8, through which a spring driven snap button protrudes thereby locking in the desired height; a lower adjustable extension section, 10, containing one spring driven snap button to lock in the desired cane height by snapping the button outward through one of the holes in the upper cane section; a knurled cam nut, 9, which is tightened once the desired height is reached; and a cane tip, 11. The cane tip is shown in one standard configuration. Other cane bottoms may be used. For example, the bottom of the cane can have a rubber-tipped four pronged balancing device. Similarly, the cane hand grip, 1, is shown in one standard configuration. However, any desired hand grip may be used in its place. The improvement to this cane comprises the Resting Device assembly which further comprises a padded foot rest section, 6; a slotted track, 3, onto which the foot rest base section may be lowered or raised; a foot rest base section, 4, which interlocks onto the slotted track, 3; an upper adjustable tightening knob, 5, which locks in the desired upper or lower position of the foot rest; and a lower adjustable tightening knob, 7, which performs the same function as the upper knob, 5.

The hand grip, 1, serves the function of allowing a person to hold the cane. One type of hand grip that performs the holding function is a handle. The upper cane section, 2, joined to the lower adjustable extension section, 10, serve the function of supporting the person. Clearly, a single-member cane without a lower adjustable extension would also support the person. Therefore, this support function may also be accomplished using a shaft or rod. An exemplary embodiment of the supporting member would be where the member has a circular cross section. The Resting Device serves the function of propping the person's foot, calf, ankle, or leg in a horizontal position while sitting. In FIG. 1 and FIG. 2, slotted track, 3, and tightening knobs, 5 and 7, function to mount foot base rest sections, 4 and 6, to the upper cane section, 2. These elements are mounted to the cane such that the height of the foot base rest section may be adjusted along the vertical length of the slotted track. The adjustment function is accomplished by loosening and tightening knobs, 5 and 7.

The Resting Device is detachable, and it can be snapped onto the cane when it is needed, or it can be snapped off when only the use of the cane is needed. Usually, when a user sits in a chair, the Resting Device is attached to the cane, and the user rests his or her calf, ankle, foot, or leg on the padded portion of the foot rest. The height of the Resting Device is adjustable for maximum comfort. While the Resting Device is in use, the cane is self standing and perfectly balanced, and the user is extremely comfortable. It can be used in this way for very long periods of time.

Figure 3:
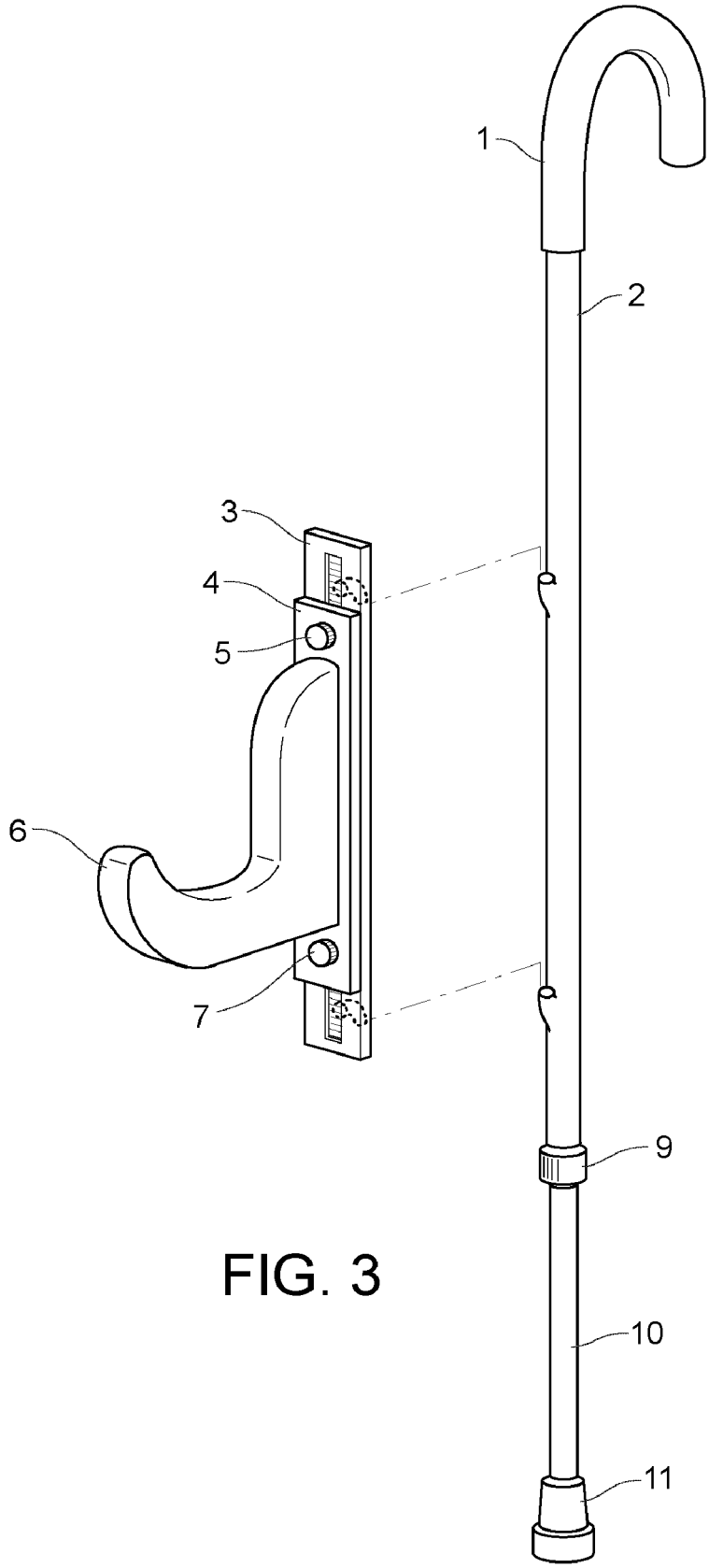
FIG. 3 is a partially exploded isometric view of the cane showing the calf, ankle, foot, or leg rest separated from the cane.
Figure 4:
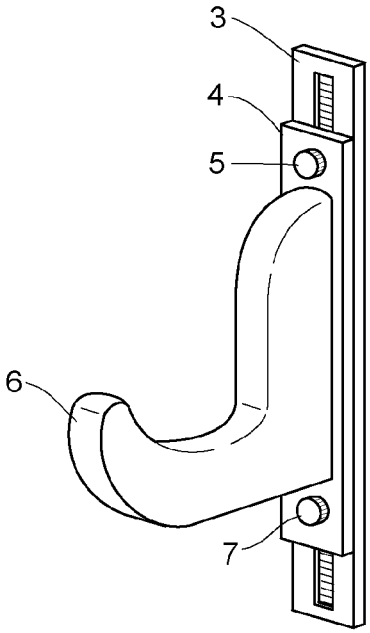
FIG. 4 is an isometric view showing details of the calf, ankle, foot, or leg rest.
Figure 5:
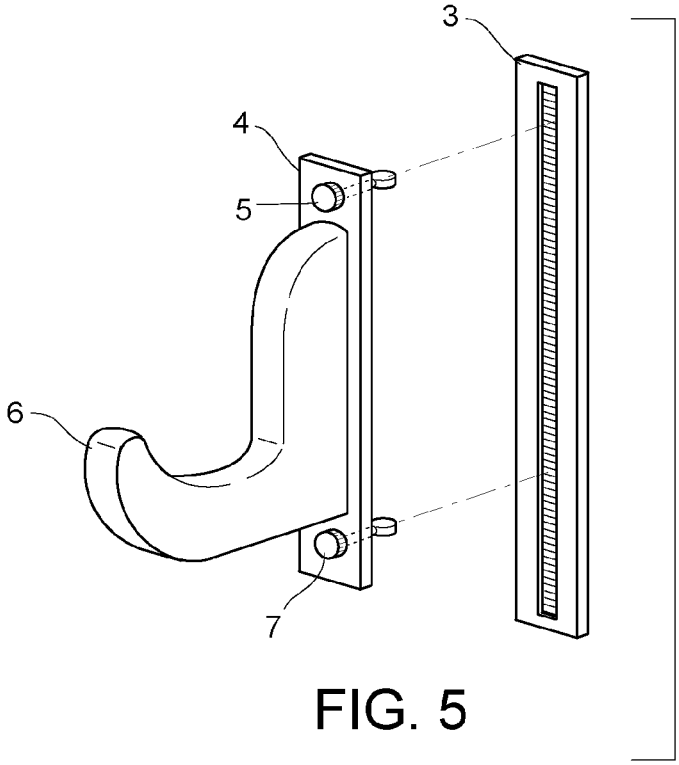
FIG. 5 is an isometric exploded view of the calf, ankle, foot, or leg rest.
Figure 10:
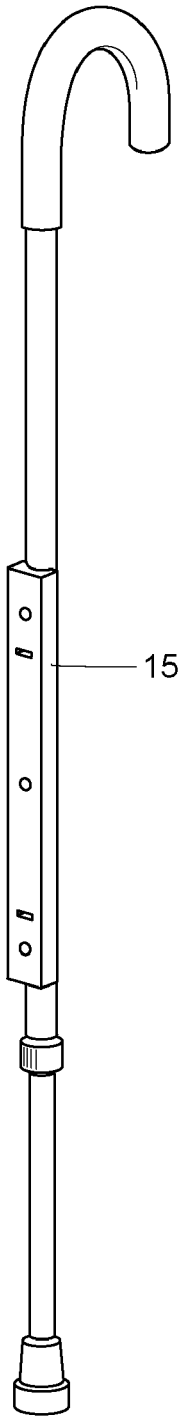
FIG. 10 is a front isometric view of the cane showing the mounting bracket to which the calf, ankle, foot, or leg rest resting device is attached.

FIG. 3 is an isometric view showing the Resting Device detached from the cane. FIG. 4 is an isometric view showing details of the Resting Device assembly, while FIG. 5 is an exploded view of the Resting Device assembly. Referring to FIG. 3, it can be seen that the entire Resting Device assembly attaches to a permanent receptor or mounting bracket which is a part of the cane. The relationship of the mounting bracket 15 to the cane is shown more clearly in FIG. 10. FIG. 4 shows the Resting Device in clearer detail. The slotted track 3, upper adjustment knob 5, the padded calf, ankle, foot, or leg rest 6, and the lower adjustment knob 7 are visible in the drawing.

Figure 6:
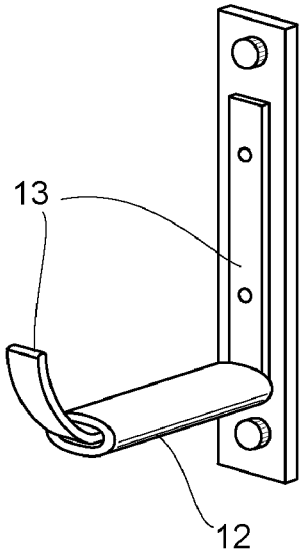
FIG. 6 is an isometric front view showing the inner layer details of construction of the calf, ankle, foot, or leg rest.
Figure 7:
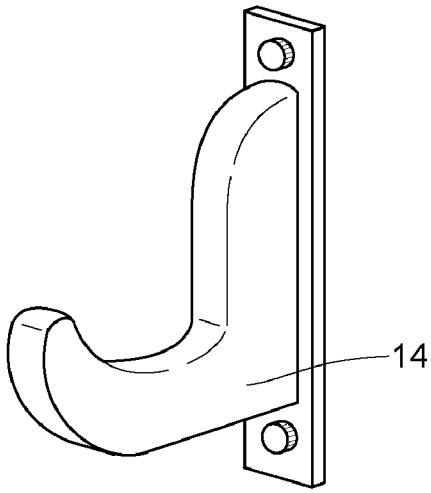
FIG. 7 is an isometric front view showing the outer layer details of construction of the calf, ankle, foot, or leg rest.
Figure 8:
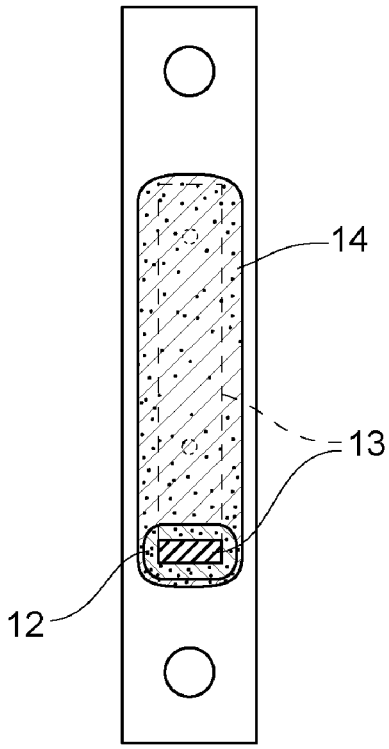
FIG. 8 is a front cross section view showing details of construction of the calf, ankle, foot, or leg rest.
Figure 9:
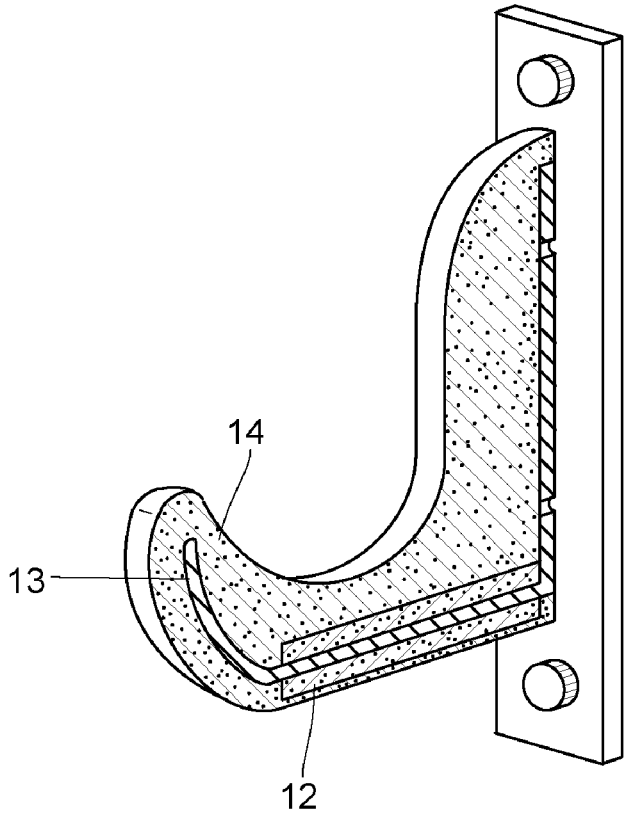
FIG. 9 is an isometric side cross section view showing details of construction of the calf, ankle, foot, or leg rest.

FIGS. 6 and 7 show details of the construction of the foot rest. FIG. 6 shows an underlayer of soft padding 12 covering the extended portion of J-shaped bracket 13 which is mounted to a fastening plate by conventional fasteners. The padding could be fabricated from a soft material such as foam rubber or memory foam, for example. The soft material is chosen upon which a foot, ankle, calf, or leg may rest comfortably. FIG. 7 shows the soft padding and all or part of the J-shaped bracket is covered by a durable material 14 (such as extra strength nylon cloth) which takes the shape of the foot rest as shown. FIG. 8 is a front cross sectional view showing the construction details. FIG. 9 is an isometric side cross sectional view also showing the construction details.

Figure 11:
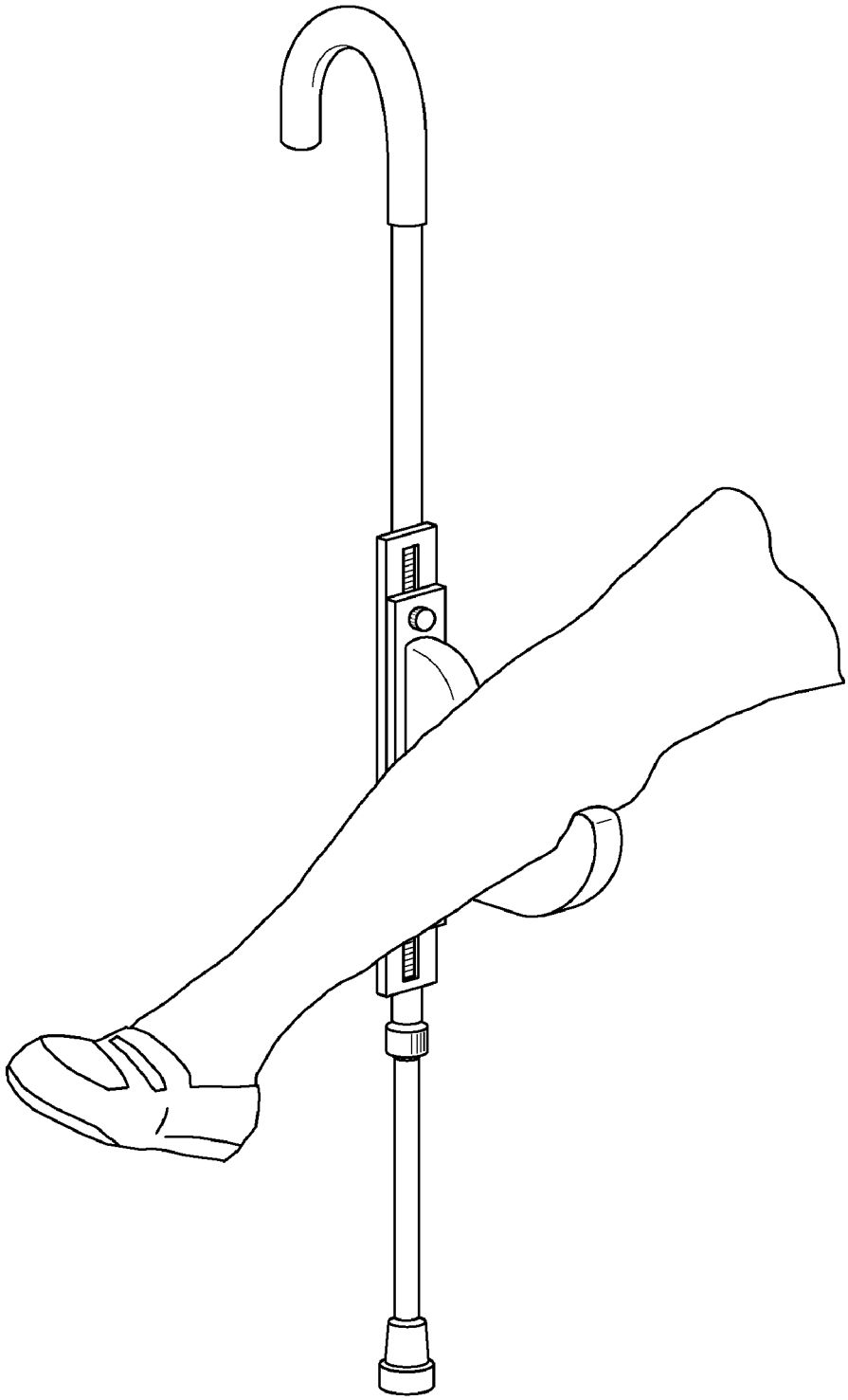
FIG. 11 shows a user resting his or her calf on the resting device.
Figure 12:
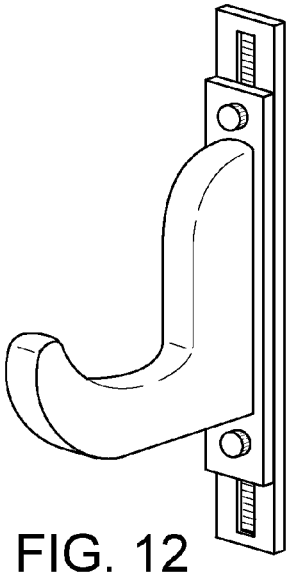
FIG. 12 shows the rest assembly adjusted to its center position on its slotted track.
Figure 13:
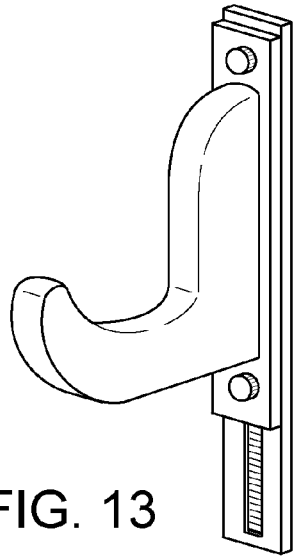
FIG. 13 shows the rest assembly adjusted to its upper-most position on its slotted track.
Figure 14:
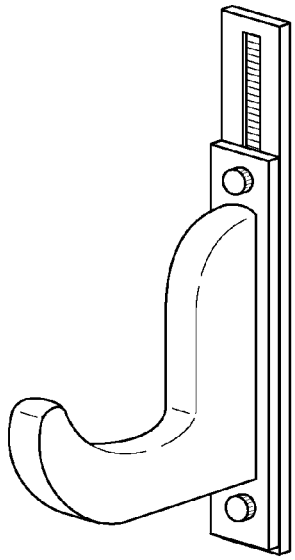
FIG. 14 shows the rest assembly adjusted to its upper-most position on its slotted track.
Figure 15A:
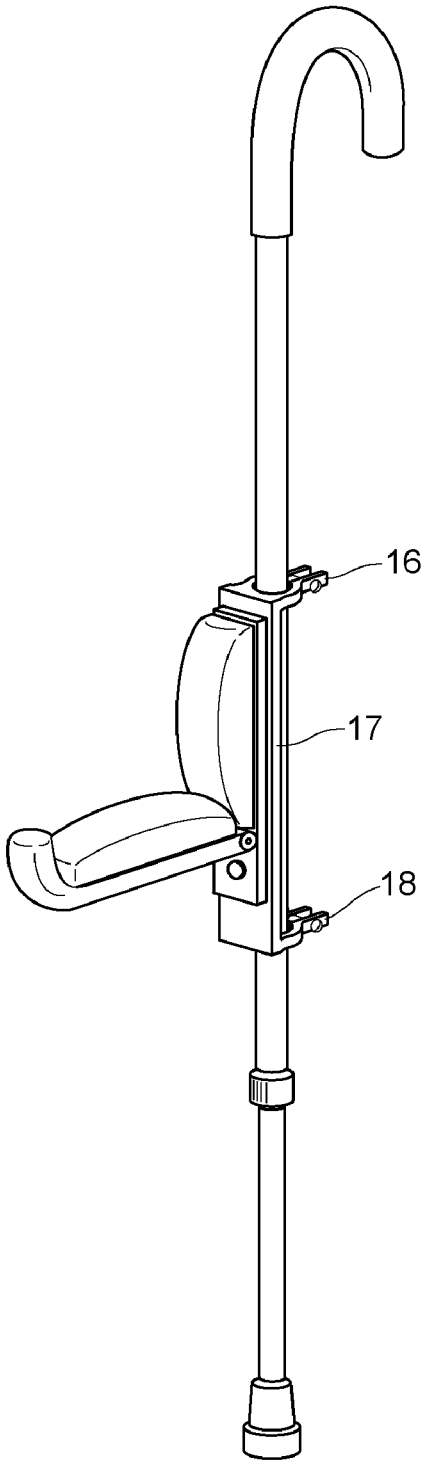
FIG. 15(*a*) is a left side isometric view of a cane with a hinged resting device mounted thereto. The resting device is extended horizontally in the "upright" (use) position.
Figure 15B:
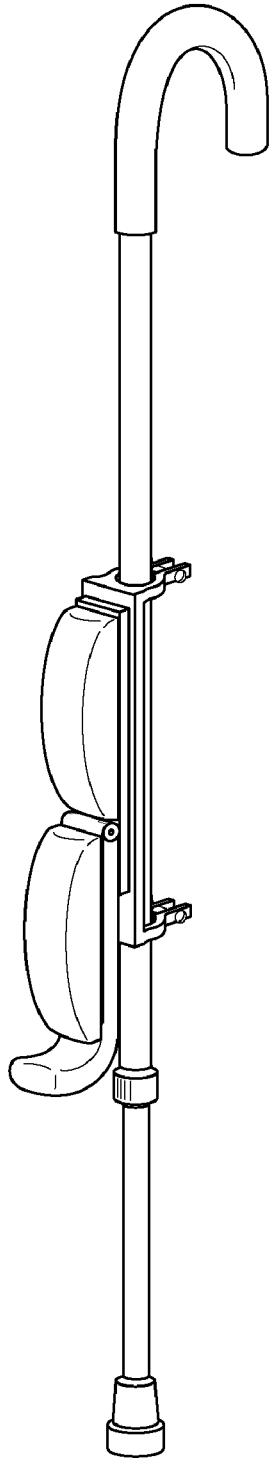
Figure 15C:
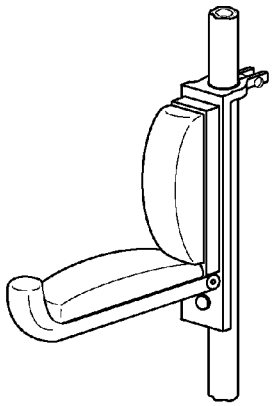
Figure 15D:
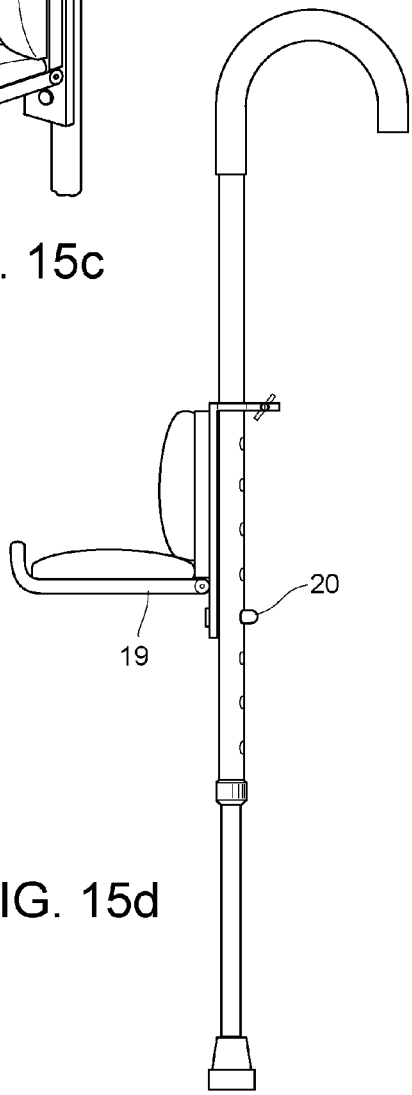
Figure 15E:
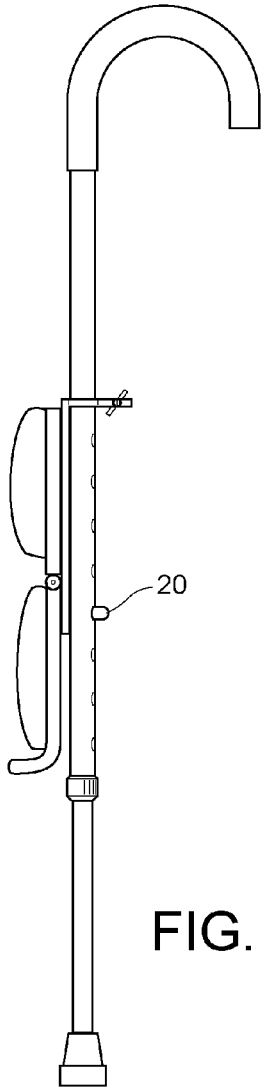
Figure 15F:
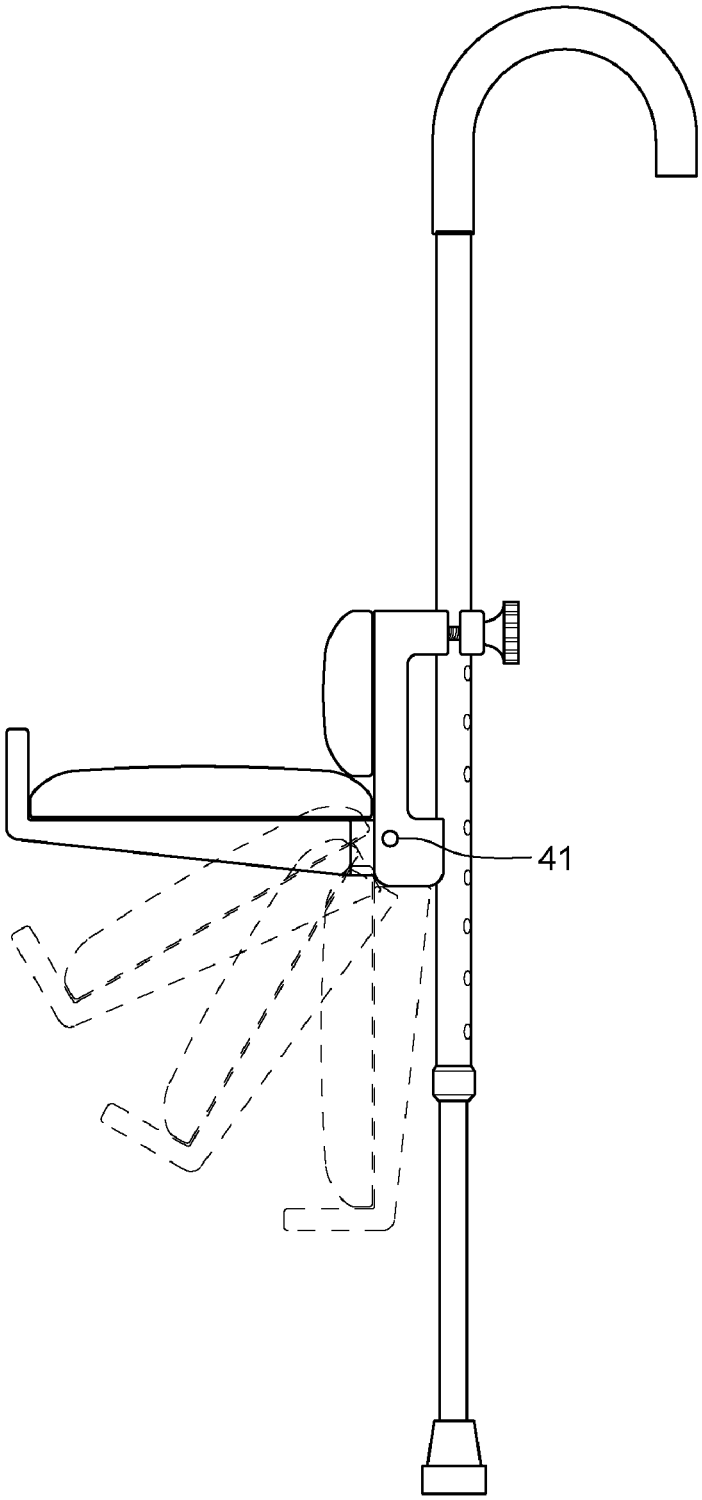
Figure 16B:
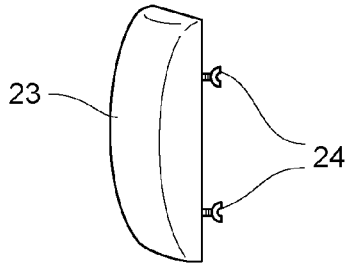
FIG. 16(*a*) shows the resting device without soft pads.
Figure 16A:
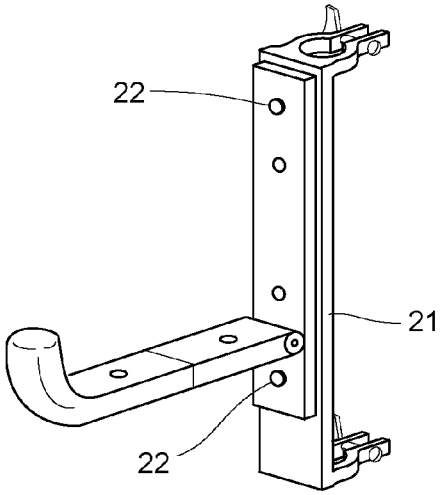
Figure 16C:
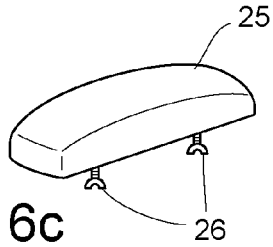
Figure 16D:
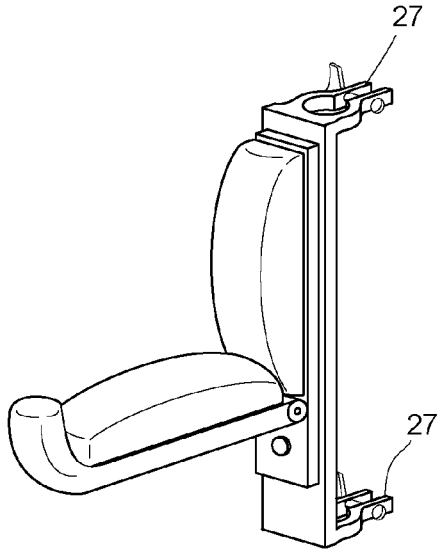

FIG. 11 is an isometric view showing a person resting his or her calf upon the Resting Device. Depending upon the desired positioning of the cane, it should be apparent that one may rest his or her ankle or heel upon the resting device also. The height of the Resting Device may be adjusted in three ways. First, referring to FIG. 1, knurled knob 9 may be used to adjust the overall height of the cane body 2 and handle 1 relative to the ground. Second, there is a series of positioning holes 8 in the cane body 2 for positioning mounting bracket 15 (see FIG. 10) so as to make it a part of the cane. The Resting Device assembly is then attached to and held in a fixed position relative to the mounting bracket. Finally, the position of the foot rest 4 may be adjusted within the length of slotted track 3. FIG. 12 shows the rest assembly adjusted to its center position on its slotted track. FIG. 13 shows the rest assembly adjusted to its upper-most position on its slotted track. Finally, FIG. 14 shows the rest assembly adjusted to its upper-most position on its slotted track.

FIG. 11 shows how the Resting Device accomplishes the function of propping a person's leg into a horizontal position while resting.

While the cane described thus far serves the purpose of allowing the user to elevate his or her leg in a horizontal position, walking with the cane while the resting device is mounted could be inconvenient for the user. First, the resting device protrudes from the cane causing it to possibly bump into objects and other people in crowded places. Second, a user might consider a protruding resting device unsightly. The improvement to the resting device is shown in FIG. 15.

FIG. 15(*a*) is a left side isometric view of a cane with the resting device mounted thereto. The right side is a mirror image of the left side. The resting device is in the extended position or the "upright" (use) position. When the resting device is extended, a user may maintain his or her leg in a horizontal orientation. A tightening wing 16 nut is provided for positioning the resting device vertically. A locking ratchet mechanism is provided to lock the resting device 17 in an extended or "flat down" position. Bolt and wing nut assembly 18 is also provided for tightening the resting device into position. FIG. 15(*b*) shows a similar view of the cane, but this time, with the resting device in the collapsed of "flat down" position. In this position, the bottom part of the "J" is parallel to the cane body and rests against the cane. It does not protrude. FIG. 15(*c*) shows the resting device fitting over a standard cane. Almost all standard canes (except for wooden canes) come with a snap button 20. The resting device slides over the cane body to the desired height up to the snap button which stabilizes and locks the resting device. FIG. 15(*d*) and FIG. 15(*e*) are left side views of the cane with the resting device mounted as described above. A locking ratchet mechanism 19 is provided to lock the resting device into the desired position. FIG. 15(*d*) shows the position of the resting device while in use, while FIG. 15(*e*) shows the position of the resting device while not in use.

In FIGS. 15(*a*) through 15(*e*), the height of the Resting Device, 17, which performs the function of propping the person's calf, ankle, foot or leg, is adjusted by loosening and tightening wing nuts, 16 and 18, as well as by pivoting the rest section into a horizontal position using the locking ratchet mechanism, 19. Therefore, in this embodiment, wing nuts, 16 and 18, perform the dual functions of mounting the Resting Device to the cane and adjusting the height, and mechanism, 19, also performs the function of height adjustment.

FIG. 15(*f*) shows the resting device in various positions between the "upright" or horizontal (use) position and the "flat down" or vertical position. The resting device pivots around pivot pin 41.

Figure 17A:
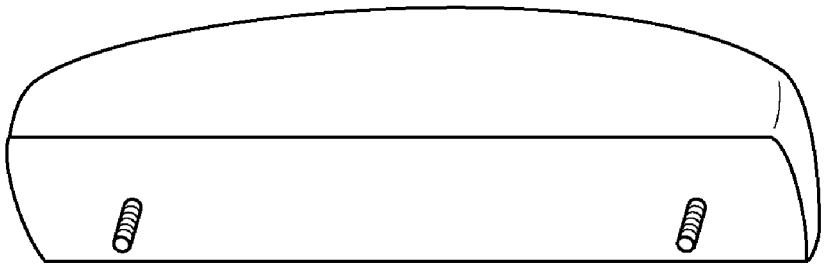
FIG. 17(*a*) shows the back pad of the resting device.
Figure 17B:
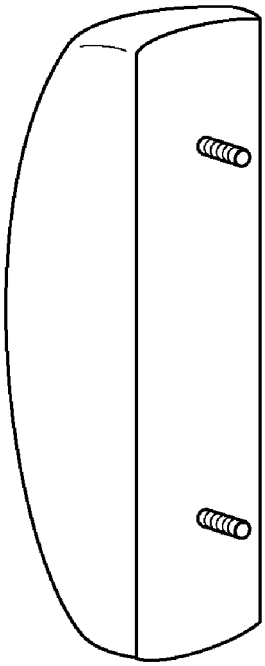

FIG. 16 shows two improvements to the resting device over that disclosed in the First Provisional Application. The first improvement is the wing nut and bolt locking mechanism that fixes the vertical position of the resting device on the cane. Bolt and nut assemblies 22 attach the resting device to the cane attachment frame. 21. The wing nut locking assemblies attach the attachment frame to the cane. Each resting device would have two such locking assemblies. The second improvement is the use of detachable cushion pads—a back pad that mounts vertically onto the resting device and a lower pad that mounts horizontally on the resting device. The pads screw onto the resting device and are held in place with two nuts. FIG. 16(*a*) shows the resting device without the pads. FIG. 16(*b*) and FIG. 16(*c*) show the pads 23 and 25 themselves, respectively, which in turn, screw on to the resting device using screws and nuts 24 and 26. FIG. 16(*d*) shows the resting device with the mounted pads. FIG. 17 shows a more detailed view of the pads. Note the wing nut locking assemblies 27. FIG. 17(*a*) shows the back pad while FIG. 17(*b*) shows the lower pad.

FIG. 18 shows another improvement to the resting device. In the First Provisional Application, the resting device was shown where the length of the bottom part of the "J" was fixed. To accommodate different sizes, different sized resting devices would need to be available. However, the bottom part of the "J" could be made adjustable. FIG. 18(*a*) shows the bottom part pushed-in to accommodate a standard width. This configuration would utilize a standard size lower pad 28. FIG. 18(*b*) shows the bottom part pulled-out to accommodate a larger size leg, calf, foot, or ankle. This configuration would utilize a larger size lower pad 29.

Figure 19B:
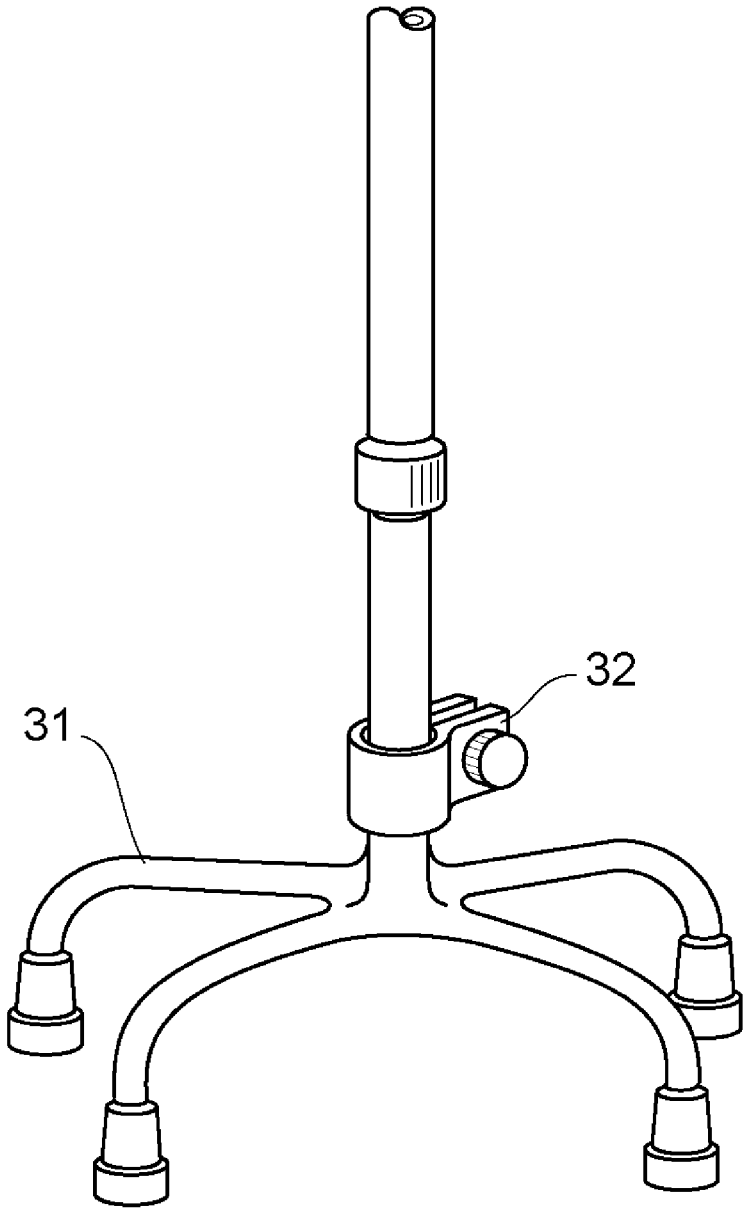
FIG. 19 shows the use of a detachable quad cane base.
Figure 20A:
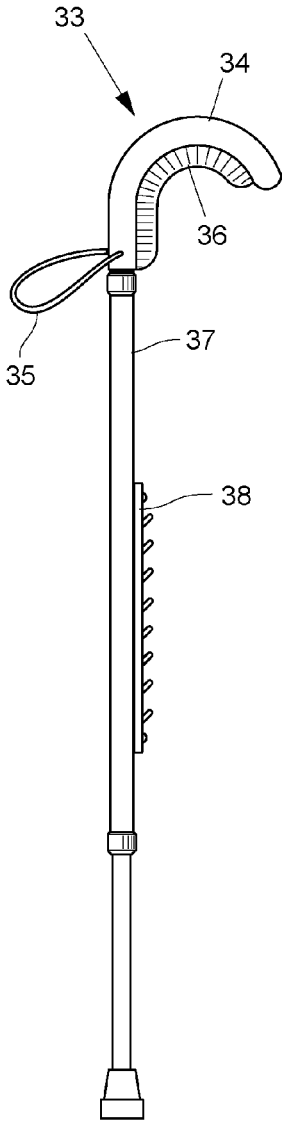
FIG. 20 shows a special cane where the cane hand rest doubles as the foot rest.
Figure 20B:
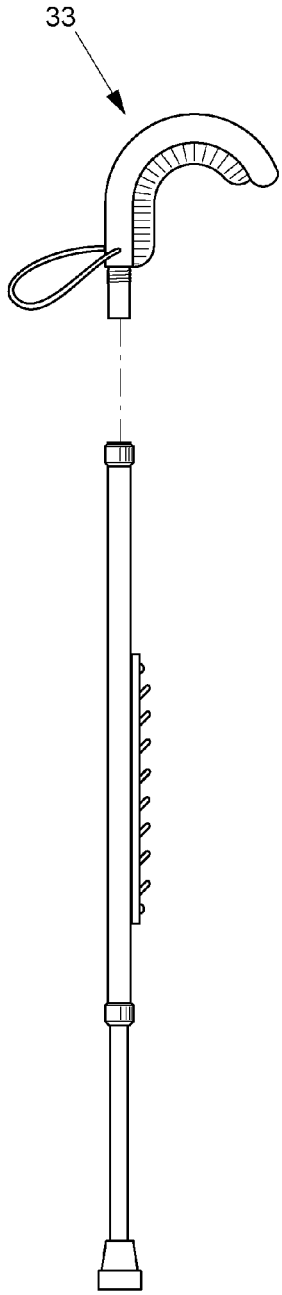
Figure 20C:
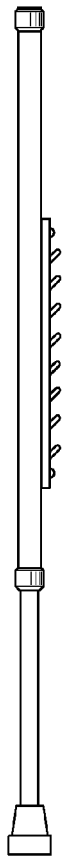
Figure 20D:
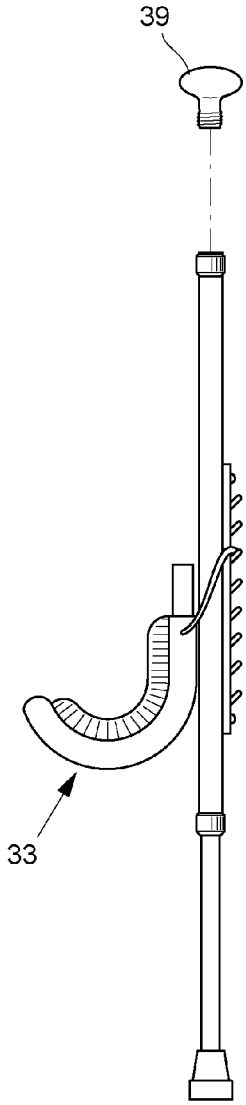

Some people need greater stability when they use a cane for walking. While a standard cane 30 would come with a single rubber tip, that tip could be removed and replaced with a detachable quad cane base 31. The quad cane base is attached to the cane using tightening knob 32. This configuration is shown in FIG. 19(*a*). FIG. 19(*b*) shows a more detailed view of the quad cane base.

FIG. 20 shows a special cane where the hand grip doubles as the resting device. FIG. 20(*a*) shows the cane in the configuration where the resting device is the hand grip 33. The hand grip outer surface 34 would be preferably made from hard rubber while the inner surface 36 would be preferably made from foam rubber covered by a stretched vinyl cloth. Attached to the handle, as shown, is a flexible steel cable 35. A height adjustment rack 38 screws onto the cane shaft. 37 The adjustment rack has a plurality of protrusions that aim upwards and outwards at an angle to the cane shaft. FIG. 20(*b*) shows that the hand grip 33 unscrews from the top of the cane shaft. FIG. 20(*c*) shows the cane shaft without the hand grip. In FIG. 20(*d*), the hand grip 33 becomes the foot resting device. The flexible steel cable holds the resting device in a fixed position relative to the cane. A small hand grip 39 screws onto the cane shaft after the resting device is attached.

Figure 21:
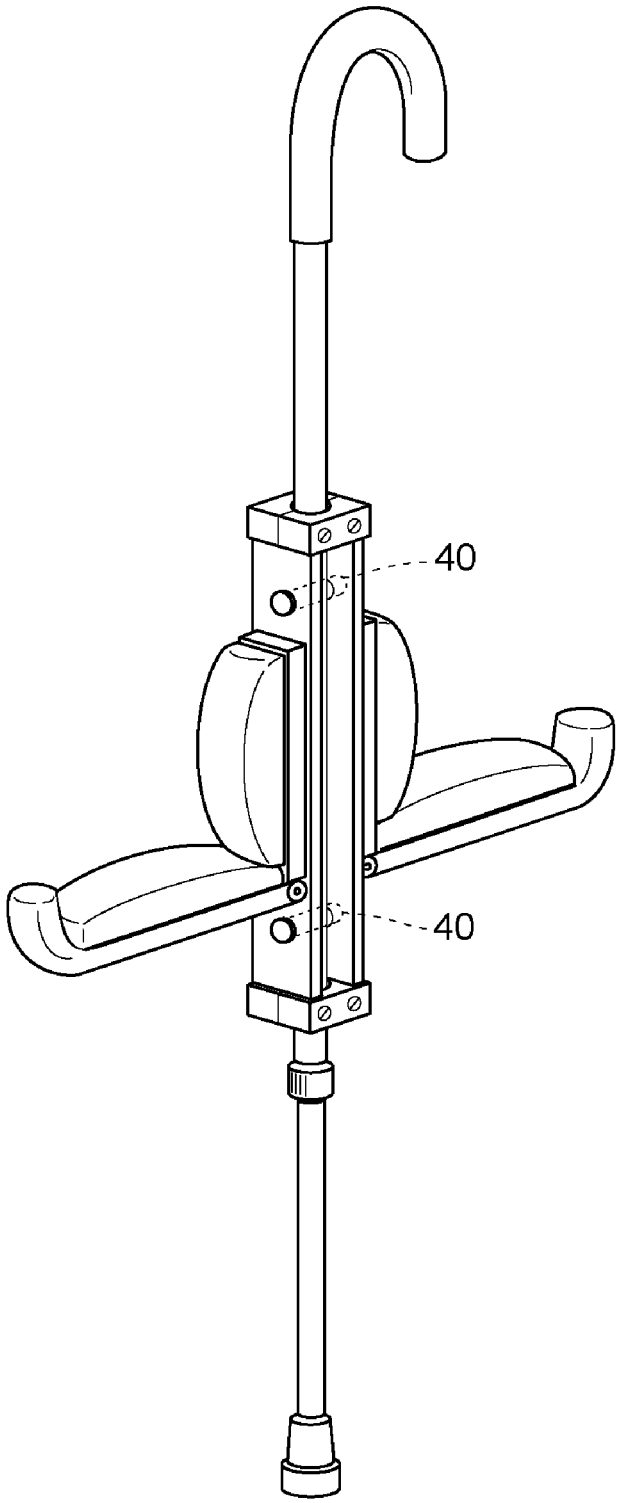
FIG. 21 shows a cane with two resting devices mounted on opposite sides of the cane.
Figure 22A:
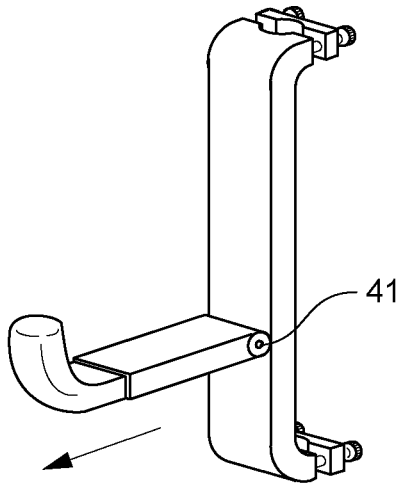
FIG. 22 shows a version of the resting device without soft pads that attaches to a standard cane.
Figure 22C:
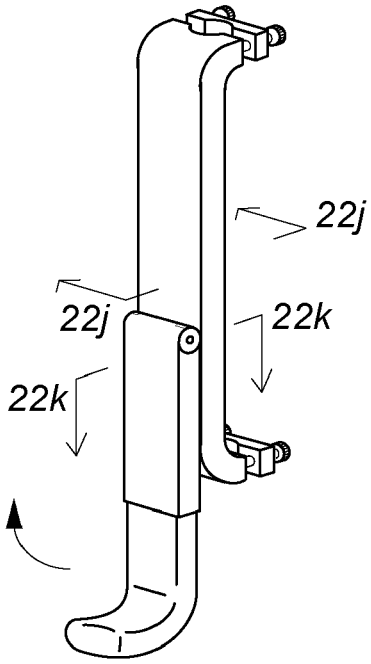
Figure 22B:
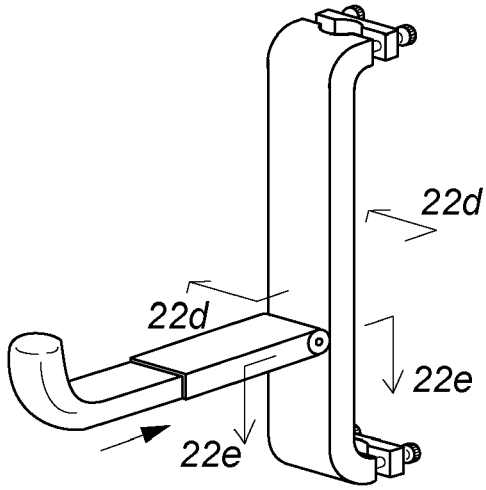
Figure 22D:
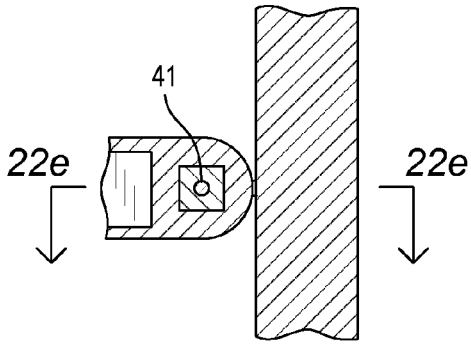
Figure 22E:
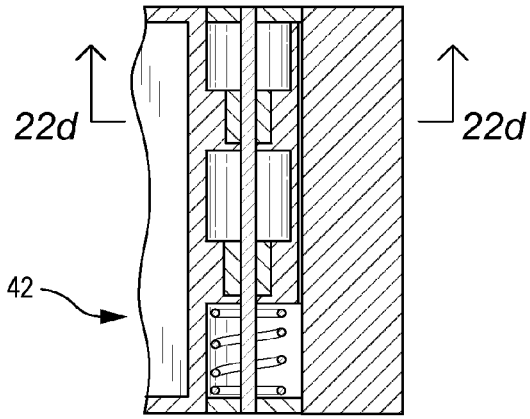
Figure 22F:
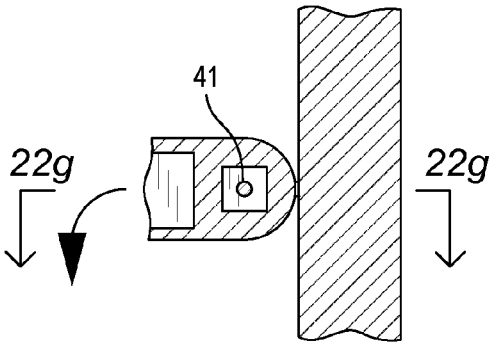
Figure 22G:
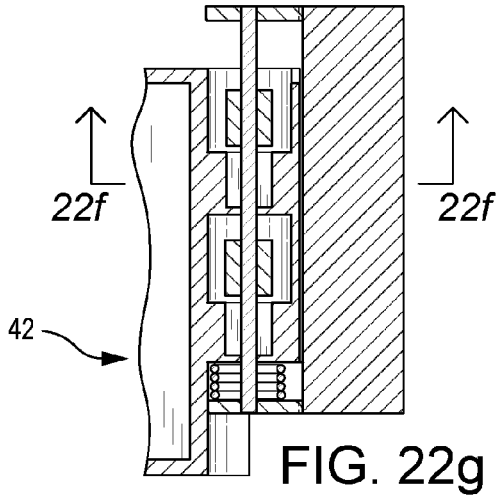
Figure 22H:
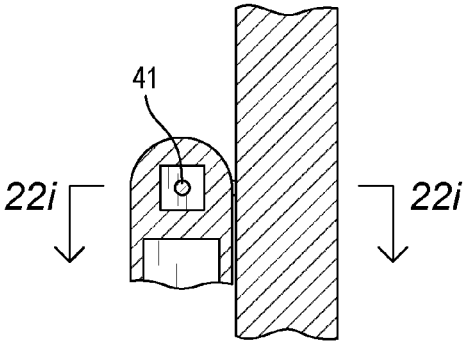
Figure 22I:
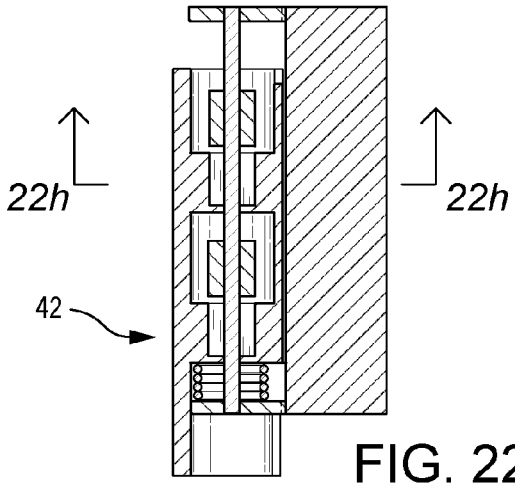
Figure 22J:
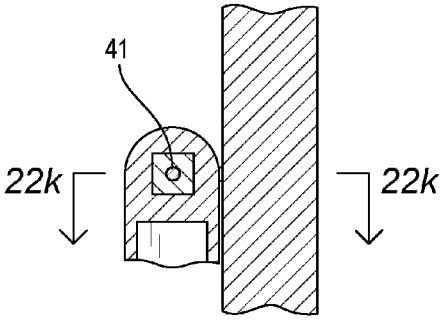
Figure 22K:
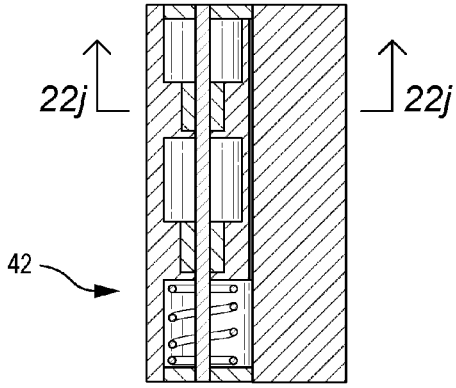

Finally, some users might want to elevate both legs in a horizontal position. This may be accomplished using two resting devices mounted on opposite sides of the cane shaft as shown in FIG. 21. Both resting devices have adjustment screws 40 that can shift the positions of the devices on the cane shaft.

FIG. 22 shows a version of the resting device without soft pads that attaches to a standard cane. FIG. 22(*a*) shows the leg rest in the standard width position and in the "upright" or horizontal position. FIG. 22(*b*) shows the leg rest in the wide width position and also in the "upright" or horizontal position. FIG. 22(*c*) shows the leg rest in the "flat down" or vertical position. The leg rest may pivot around pivot point 41 to be either in the horizontal position as shown in FIGS. 22(*a*) and 22(*b*) or the vertical position as shown in FIG. 22(*c*). In order for a person to rest his leg on the horizontal leg rest, the leg rest must lock into position horizontally. When the cane is used simply as a cane, the leg rest should be locked into position vertically. It should be unlocked only when pivoting around 41 between the horizontal and vertical orientations. Any prior art (or potentially novel) locking mechanisms may be used to accomplish this purpose.

FIG. 22(*d*) through 22(*k*) are cross-sectional views corresponding to FIGS. 22(*b*) and 22(*c*). FIG. 22(*d*) is a cross-sectional view of the leg rest and pivot point indicated by the section marking in FIG. 22(*b*). The leg rest is in the horizontal position. FIG. 22(*e*) is a cross-sectional view of a typical lock mechanism 42 indicated by the section marking in FIG. 22(*b*) where the leg rest is in the horizontal locked position. Lock mechanism 42 (shown in the drawing) is but an example of many lock mechanisms that may be used for this purpose. FIG. 22(*e*) corresponds to the condition of the leg rest in FIG. 22(*d*).

FIG. 22(*f*) is a cross-sectional view of the leg rest and pivot 41 indicated by the section marking in FIG. 22(*b*). The leg rest is in the horizontal position, but unlocked to pivot downward. FIG. 22(*f*) is a cross-sectional view of the leg rest and pivot 41 indicated by the section marking in FIG. 22(*b*). The leg rest is in the horizontal position, but unlocked to pivot downward. FIG. 22(*g*) is a cross-sectional view of the typical lock mechanism 42 of FIG. 22(*e*) and corresponding to the condition of the leg rest in FIG. 22(*f*), where the leg rest is in the horizontal unlocked position.

FIG. 22(*h*) is a cross-sectional view of the leg rest and pivot 41 corresponding to the view in FIG. 22(*c*), where the leg rest is in the vertical unlocked position. FIG. 22(*i*) is a cross-sectional view of the typical lock mechanism 42 of FIG. 22(*e*), and corresponding to the condition of the leg rest in FIG. 22(*h*), where the leg rest is in the vertical unlocked position.

FIG. 22(*j*) is a cross-sectional view of the leg rest and pivot 41, indicated by the section marking in FIG. 22(*c*). The leg rest is in the vertical locked position. FIG. 22(*k*) is a cross-sectional view of the typical lock mechanism 42 of FIG. 22(*e*), as indicated by the section marking in FIG. 22(*c*), where the leg rest is in the vertical locked position. FIG. 22(*k*) corresponds to the condition of the leg rest in FIG. 22(*j*).

Figure 23A:
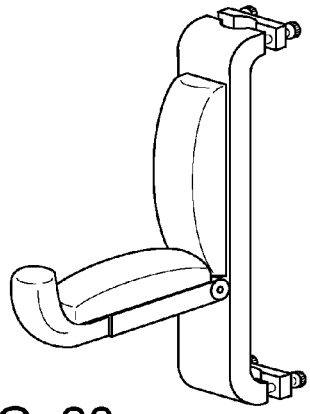
FIG. 23 shows the resting device of FIG. 22 with soft pads.
Figure 23B:
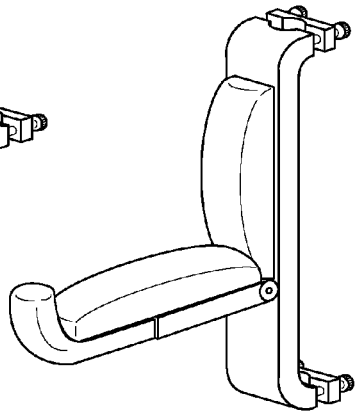
Figure 23C:
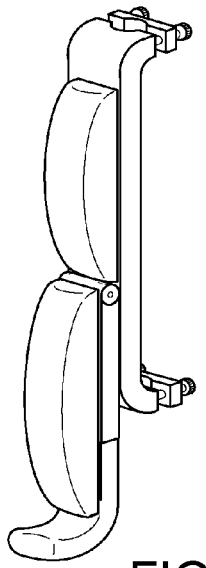

FIG. 23 shows the leg rest device of FIG. 22 with soft pads. FIG. 23(*a*) shows the leg rest in the standard width position and in the "upright" horizontal orientation. FIG. 23(*b*) shows the leg rest in the wide width position and in the "upright" horizontal orientation. FIG. 23(*c*) shows the leg rest in the "flat down" or vertical orientation.

Figure 24:
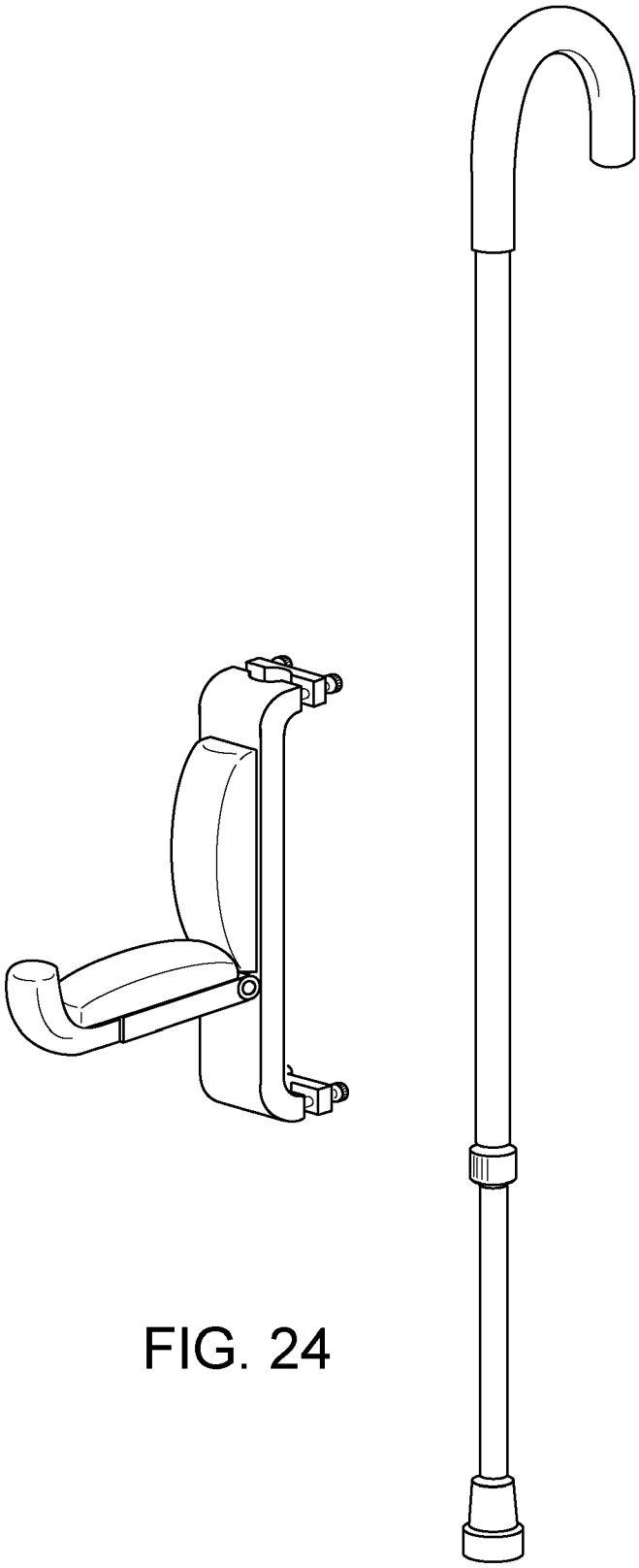
FIG. 24 suggests how the resting device of FIG. 23 would attach to a standard cane.

FIG. 24 suggests how the leg rest of FIG. 23 would attach to a standard cane.

Figure 25A:
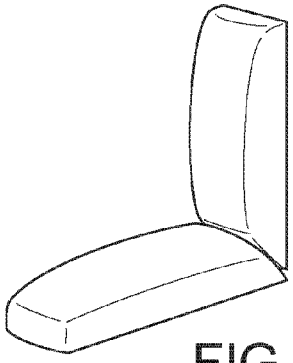
FIG. 25(*a*) shows standard width horizontal and vertical soft pads together.
Figure 25B:
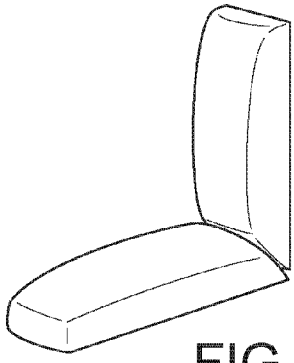
Figure 26A:
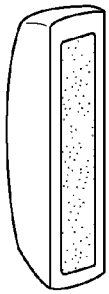
FIG. 26 shows soft pads that attach to the resting device with Velcro™.hook-and-loop attachment strips.
Figure 26B:
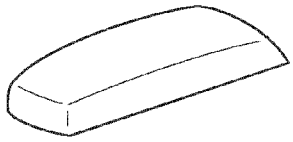
Figure 26C:
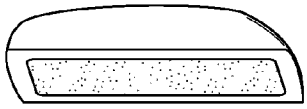
Figure 26D:
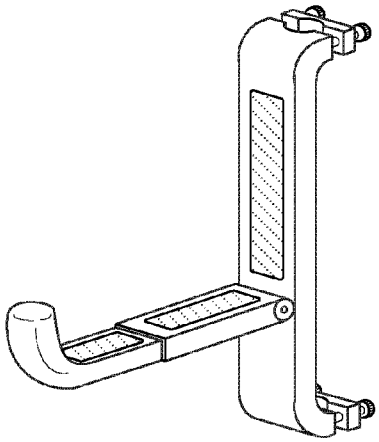
Figure 26E:
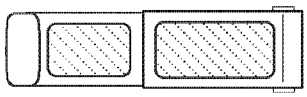

FIG. 25(*a*) shows standard width horizontal and vertical soft pads together. FIG. 25(*b*) shows wide width horizontal and vertical soft pads together.

FIG. 26 shows soft pads that attach to the leg rest with Velcro™ hook-and-loop attachment strips. FIG. 26(*a*) shows the mounting of the attachment strip on the rear surface of the vertical soft pad. FIG. 26(*b*) shows the front surface of either the horizontal or the vertical soft pad. FIG. 26(*c*) shows the mounting of the attachment strip on the rear surface of the horizontal soft pad. FIG. 26(*d*) shows the mating attachment strips mounted on the resting device in the "upright" horizontal orientation. FIG. 26(*e*) shows the mating attachment strips mounted on the resting device in the "flat down" vertical orientation.

The invention claimed is:

1. A cane or walking stick device that helps a person to walk or stand and that allows the person to extend and maintain his or her leg in an essentially horizontal position while seated, said device comprising:

a) a means for supporting the person while walking or standing, wherein said means for supporting has length, and a longitudinal direction, and extends essentially vertically to a desired height;

b) a means for holding the means for supporting by the person; and, c) a means for propping the person's calf, ankle, foot, or leg while seated, wherein:

i) said means for propping comprises a rigid bracket means which further comprises a means for mounting said rigid bracket means to the means for supporting with at least two mounting points and a means for resting the person's calf, ankle, foot, or leg;

ii) said means for resting the person's calf, ankle foot, or leg further comprises an upper padded straight element and a lower padded straight element;

iii) the upper padded straight element is mounted to the means for supporting in the direction of said means for supporting;

iv) the lower padded straight element is pivotally connected to the upper padded element so that it may move angularly at its pivot, ranging from a direction along said means for supporting to a direction essentially perpendicular to said means for supporting;

v) said means for propping further comprises a pivoting means that permits the means for propping to entirely touch the means for supporting so that the means for propping is not extended essentially perpendicular to the means for supporting when the person desires to use the device to assist in walking or standing, vi) when the lower padded straight element extends in a direction essentially perpendicular to said means for supporting, it becomes locked into that position, and remains locked in that position until it is manually released.

2. The device of claim 1 wherein the means for supporting is a shaft or rod.

3. The device of claim 2 wherein the means for supporting has a circular cross section.

4. The device of claim 1 wherein the means for holding is the shaft or rod itself.

5. The device of claim 1 wherein the means for holding is a handle having a desired shape.

6. The device of claim 1 further comprising a second means for propping identical to said means for propping, and also extending essentially perpendicular to the means for supporting in such manner that the person may simultaneously extend and maintain both legs leg in an essentially horizontal position while seated.

7. The device of claim 1 wherein the means for propping is adjustable so as to accommodate calves, ankles, feet, or legs of varying sizes.

8. The device of claim 1 further comprising a means for adjusting the position of the means for propping at a plurality of discreet positions along the length of the means for supporting.

9. The device of claim 1 further comprising a means for adjusting the position of the means for propping continuously along the length of the means for supporting.

10. A cane or walking stick device that helps a person to walk or stand and that allows a person to extend and maintain his or her leg in an essentially horizontal position while seated, said device comprising:

a) a shaft having length, and a longitudinal direction, and comprising first and second ends;

b) a base at the first end of the shaft, said base allowing the device to rest on the floor with the shaft extending essentially vertically; and, c) a resting device mounted to the shaft at a selected position along its length, said resting device being configured to allow the person while seated to rest his or her calf, ankle, foot, or leg thereon, wherein:

i) said resting device comprises a rigid mounting bracket that mounts to the shaft in at least two mounting points;

ii) said resting device further comprises a rigid upper padded straight element and a rigid lower padded straight element;

iii) the rigid upper padded straight element extends along the longitudinal direction of the shaft;

iv) the rigid lower padded straight element is connected to the rigid upper padded straight element using a pivot mechanism that allows the rigid lower padded straight element to move angularly ranging from the longitudinal direction of the shaft to a direction essentially perpendicular to the shaft;

v) the resting device is configured so that it may entirely touch the shaft when the rigid lower padded straight element is not extended essentially perpendicular to the shaft; and vi) the pivot mechanism permits the rigid lower padded straight element to entirely touch the shaft so that it is optionally not extended essentially perpendicular to the shaft when the person desires to use the cane or walking stick device to assist in walking or standing vii) when the rigid lower padded straight element extends in a direction essentially perpendicular to the shaft, it becomes locked into that position, and remains locked in that position until it is manually released.

11. The device of claim 10 wherein the shaft is a cylinder.

12. The device of claim 10 wherein the shaft is hollow.

13. The device of claim 10 wherein the shaft has a plurality of positioning holes drilled along the length of the shaft to allow the resting device to be positioned at selected positions along the length of the shaft.

14. The device of claim 10 wherein the base comprises an elastic non-slip tip.

15. The device of claim 10 wherein the base comprises multiple prongs.

16. The device of claim 10 further comprising a) a rigid bracket having a mounting portion with at least two mounting points and a resting portion;

b) resilient padding;

c) a mounting bracket upon which the resting device is attached, said mounting bracket attaching to the cane or walking stick device;

d) a track having a length shorter than that of the rigid mounting bracket which allows the position of the rigid lower padded straight element to be finely adjusted; and, e) tightening screws to lock the position of the resting device on the track.

17. The device of claim 10 wherein the resting device further comprises two clamps for continuously positioning the resting device along the length of the shaft.

18. The device of claim 10 further comprising a handle having a desired shape at the second end of the shaft.

19. A calf, ankle, foot, or leg resting device adapted to be mounted on a cane, said resting device comprising:

a) a rigid bracket having a mounting portion with at least two mounting points and a resting portion;

b) two rigid padded straight elements having resilient padding; and c) a pivoting mechanism further comprising a locking mechanism;

wherein:

i) the two rigid padded straight elements are pivotally connected at a pivot point within the pivoting mechanism such that one of the two rigid padded straight elements can pivot angularly around the pivot point at angles ranging from 90 degrees to 180 degrees; and ii) the two rigid padded straight elements can be locked into position by the locking mechanism when they are essentially perpendicular to each other until they are manually unlocked.

20. The resting device of claim 19 further comprising a mounting bracket upon which the resting device is attached, said mounting bracket useable for mounting onto a cane.

21. The resting device of claim 20 further comprising:

a) a track having a length shorter than that of the mounting bracket which allows the positions of the resting device to be finely adjusted; and, b) tightening screws to lock the position of the resting device on the track.

22. A cane or walking stick comprising a shaft having length and a longitudinal direction, wherein the improvement comprises a resting device that further comprises a rigid bracket having a mounting portion with at least two mounting points, a pivot mechanism, a rigid upper padded straight element, and a rigid lower padded straight element, wherein:

a) the rigid upper padded straight element extends along the longitudinal direction of the shaft;

b) the rigid lower padded straight element is connected to the rigid upper padded straight element at the pivot mechanism that allows the rigid lower padded straight element to move angularly ranging from the longitudinal direction of the shaft to a direction essentially perpendicular to the shaft, c) The pivot mechanism further comprises a locking mechanism that permits the rigid lower padded straight element to be locked into position when extended essentially perpendicular to the shaft until manually released; and d) the pivot mechanism permits the rigid lower padded straight element to entirely touch the shaft so that it is optionally not extended essentially perpendicular to the shaft when the person desires to use the cane or walking stick to assist in walking or standing.

23. The cane or walking stick of claim 22, wherein the improvement further comprises:

a) a track having a length shorter than that of the mounting bracket which allows the position of the resting device to be finely adjusted; and, b) tightening screws to lock the position of the resting device on the track.

24. The cane or walking stick of claim 22, wherein the improvement further comprises two resting devices being configured to allow the person while seated to rest both of his or her calves, ankles, feet, or legs thereon.

25. The cane or walking stick of claim 22, wherein the resting device is detachable.

26. The cane or walking stick of claim 22, wherein the resting device is configurable by the person so as to remain attached to the cane or walking stick but to optionally not protrude.

* * * * *